United States Patent [19]

Naya et al.

[11] Patent Number: 4,575,451

[45] Date of Patent: Mar. 11, 1986

[54] CONTACT MATERIAL FOR VACUUM CIRCUIT BREAKER

[75] Inventors: Eizo Naya, Ibaragi; Mitsuhiro Okumura, Sakai, both of Japan

[73] Assignee: Mitsubishi Denki Kabushiki Kaisha, Tokyo, Japan

[21] Appl. No.: 552,442

[22] Filed: Nov. 16, 1983

[30] Foreign Application Priority Data

| | | | |
|---|---|---|---|
| Nov. 16, 1982 | [JP] | Japan | 57-202530 |
| Apr. 29, 1983 | [JP] | Japan | 58-76720 |
| Apr. 29, 1983 | [JP] | Japan | 58-76721 |
| Apr. 29, 1983 | [JP] | Japan | 58-76722 |

[51] Int. Cl.[4] ..... C22C 9/00; C22C 30/02

[52] U.S. Cl. ..... 420/489; 420/491; 420/494; 420/495; 420/499; 420/500; 420/587; 420/588; 420/492; 200/266

[58] Field of Search ..... 420/489, 490, 491, 492, 420/494, 495, 469, 499, 500, 580, 587, 588; 148/432, 436; 200/265, 266

[56] References Cited

U.S. PATENT DOCUMENTS

| | | | |
|---|---|---|---|
| 1,375,454 | 4/1921 | Hansen | 420/495 |
| 2,311,750 | 2/1943 | Hensel et al. | 420/495 |
| 3,246,979 | 4/1966 | Lafferty et al. | 420/491 |
| 3,379,846 | 4/1968 | Wood et al. | 200/267 |
| 3,514,559 | 5/1970 | Ranheim | 200/264 |
| 3,627,963 | 12/1971 | Lindsay | 200/270 |
| 4,008,081 | 2/1977 | Hundstad | 420/495 |
| 4,032,301 | 6/1977 | Hassler et al. | 200/265 |
| 4,347,413 | 8/1982 | Wantanabe et al. | 200/262 |
| 4,378,330 | 3/1983 | Verhoeven et al. | 420/495 |

FOREIGN PATENT DOCUMENTS

| | | | |
|---|---|---|---|
| 1198566 | 8/1965 | Fed. Rep. of Germany | 420/495 |
| 133442 | 10/1981 | Japan | 420/495 |
| 1255685 | 12/1971 | United Kingdom . | |
| 1549107 | 7/1979 | United Kingdom . | |
| 2045002 | 10/1980 | United Kingdom . | |

*Primary Examiner*—L. Dewayne Rutledge
*Assistant Examiner*—Robert McDowell
*Attorney, Agent, or Firm*—Oblon, Fisher, Spivak, McClelland & Maier

[57] ABSTRACT

A contact material for a vacuum circuit breaker consists essentially of copper as the basic component, and, as the other components, 35% by weight or below of chromium and 50% by weight or below of niobium, the total quantity of chromium and niobium in said contact material being 10% by weight and above.

16 Claims, 19 Drawing Figures

CONTACT MATERIAL FOR VACUUM CIRCUIT BREAKER

This invention relates to a contact material for a vacuum circuit breaker which is excellent in large current breaking property and high voltage withstand capability.

The vacuum circuit breaker has various advantages such that it is free from maintenance, does not bring about public pollution, is excellent in its current breaking property, and so forth, hence the extent of its applications has become widened very rapidly. With this expansion in its utility, demands for higher voltage withstand property and larger current breaking capability of the vacuum circuit breaker have become increasingly high. On the other hand, the performance of the vacuum circuit breaker depends to a large extent on the element to be determined by the contact material placed within a vacuum container for the vacuum circuit breaker.

For the characteristics of the contact material for the vacuum circuit breaker to satisfy, there may be enumerated: (1) large current breaking capacity; (2) high voltage withstand; (3) small contact resistance; (4) small melt-adhesion; (5) low consumption rate of the contact; (6) small breaking current; (7) good workability; (8) sufficient mechanical strength; and so forth.

In the actual contact material, it is fairly difficult to satisfy all of these characteristics, and general circumstances at the present are such that use is made of a material which meets particularly important characteristic depending on its utilization at the sacrifice of other characteristics to some extent.

There have so far been used as this kind of the contact material a copper-bismuth alloy (hereinafter simply indicated as "Cu—Bi"; for other elements and alloys made up of combination of those elements will also be indicated by the elemental symbols in the same manner as above), Cu—Cr—Bi, Cu—Co—Bi, Cu—Cr, and others. However, with the alloy contact such as Cu—Bi, etc. containing therein a low melting point metal, a part of the metal in the alloy component diffuses and evaporates from the contact to adhere to the metal shield and the insulative container in the vacuum vessel. This adhesion of the evaporated metal constitutes one of the serious causes for deteriorating the voltage withstand of the vacuum circuit breaker. The evaporation and scattering of the low melting point metal also take place even at the time of opening and closing of a load and large current breaking, whereby there are observed deterioration in the voltage withstand and lowering in the current breaking capability. Even with Cu—Cr—Bi alloy having chromium and cobalt excellent in the voltage withstand in the vacuum added to the alloy with a view to eliminating the above-mentioned disadvantages, such disadvantages as mentioned above due to the low melting point metal cannot be solved perfectly, hence the vacuum circuit breaker is not able to withstand high voltage and large current. On the other hand, an alloy material such as Cu—Cr, etc. consisting of a metal (such as Cr, Co, etc.) excellent in the vacuum voltage withstand and Cu excellent in the electrical conductivity in combination is superior in its current breaking and voltage withstand capabilities, though somewhat inferior to the contact material containing the low melting point metal as to its anti-welding capability, hence it has been well utilized in the high voltage and large current region. Further, the Cu—Cr alloy has its own limitation in the current breaking capability, on account of which efforts have been made as to increasing the current breaking capability by contriving the shape of the contact and manipulating the current path at the contact part to generate the magnetic field and compulsorily drive the large current arc with the force of the magnetic field.

However, since the demands for higher voltage withstand and larger current breaking capabilities of the vacuum circuit breaker have become increasingly high, it is now difficult to attain satisfactorily the performances as demanded with the conventional contact material; likewise, the capabilities of the conventional contact material are not sufficient for the size-reduction of the vacuum circuit breaker, so that the contact material having more excellent capabilities have been sought for.

In view of the above-described various shortcoming inherent in the conventional vacuum circuit breaker, it is the primary object of the present invention to provide a contact material for the vacuum circuit breaker which is excellent in the large current breaking characteristics and has high voltage withstand capability.

With a view to achieving the abovementioned object, the present inventors experimentally prepared the contact materials, in which various sorts of metals, alloys and intermetallic compounds were added to copper and each of these contact materials was assembled in the vacuum circuit breaker to conduct various experiments. The results of the experiments revealed that those contact materials, in which copper, chromium and niobium are distributed in the base material as a single substance or at least one kind of an alloy of these three metals, alloys of two of these metals, an intermetallic compound of these three metals, intermetallic compounds of two of these metals, and a composite body of these, are very excellent in the current breaking capability.

According to the present invention, in one aspect of it, there is provided a contact material for a vacuum circuit breaker which consists essentially of copper as the basic component, and, as other components, 35% by weight or below of chromium and 40% by weight or below of niobium wherein copper, chromium and niobium are distributed therein in the form of a single metal or as at least one kind of a ternary alloy of these metals, a binary alloy of these metals, a ternary intermetallic compound of these metals, a binary intermetallic compound of these metals, and a composite body of these.

According to the present invention, in still another aspect of it, there is provided a contact material for a vacuum circuit breaker which consists essentially of copper as the basic component, and, as other components, 10 to 35% by weight of chromium and 20% by weight or below of niobium, and, as additives in a small quantity, 1% by weight or below of aluminum.

According to the present invention, in another aspect of it there is provided a contact material for a vacuum circuit breaker which consists essentially of copper as the basic component, and, as other components, 10 to 35% by weight of chromium and 15% by weight or below of niobium and, as additives in a small quantity, 1% by weight or below of titanium, or 0.8% by weight or below zirconium.

The foregoing object, other objects as well as specific constituent elements, mixing ratio of these constituent elements, and the effects to be derived therefrom of the contact material according to the present invention will become more apparent and understandable from the following detailed description and specific examples thereof, when read in conjunction with the accompanying drawing.

Figure 14:
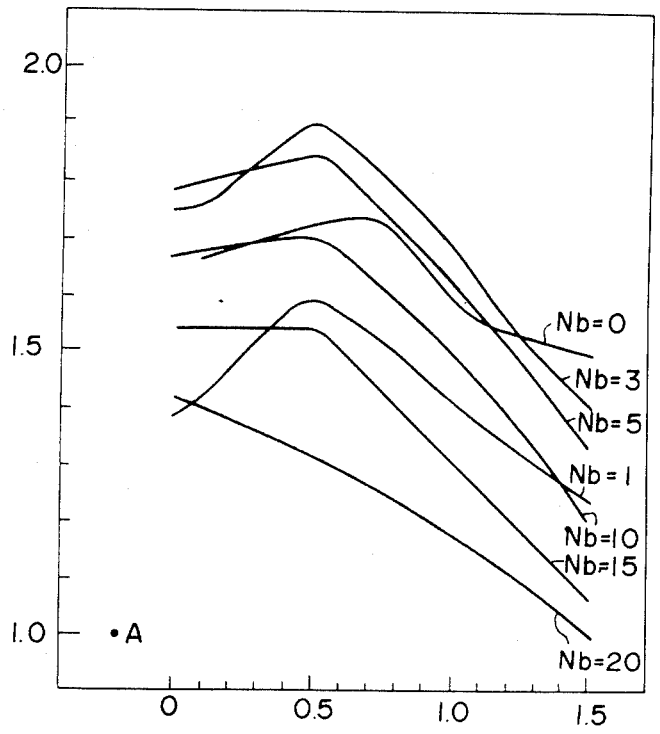
Figure 15:
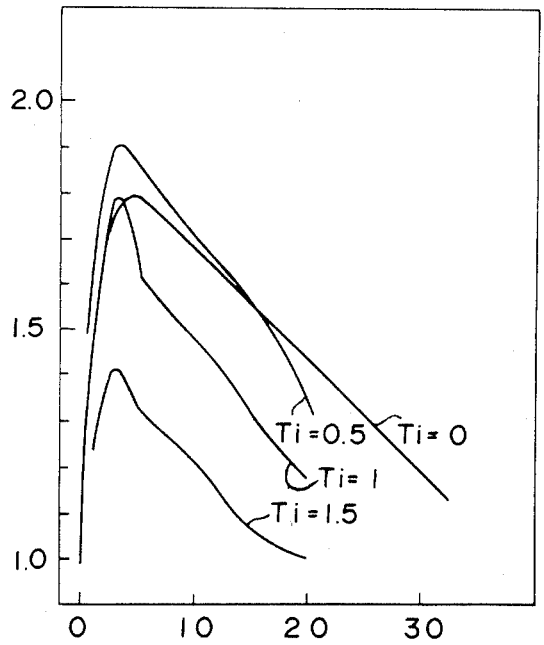
Figure 16:
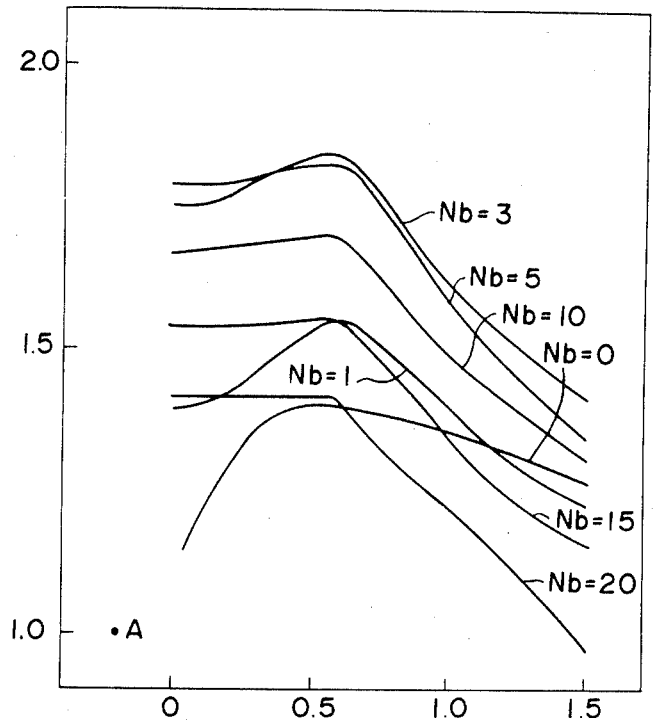
Figure 17:
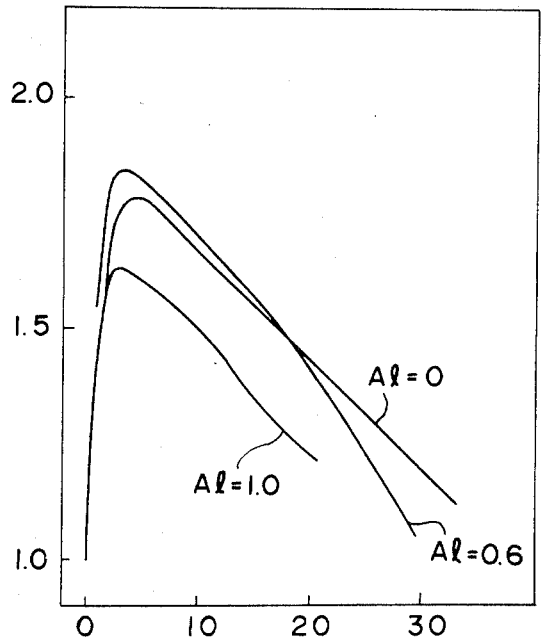
Figure 18:
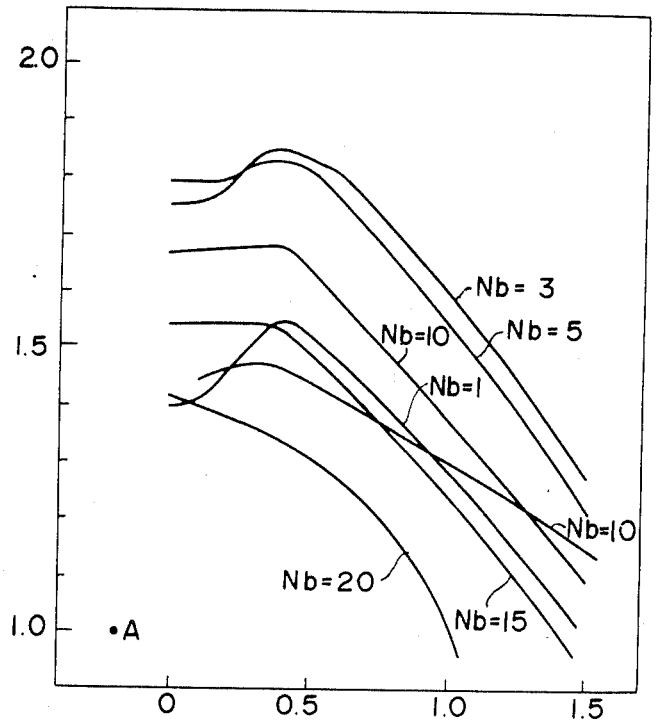
Figure 19:
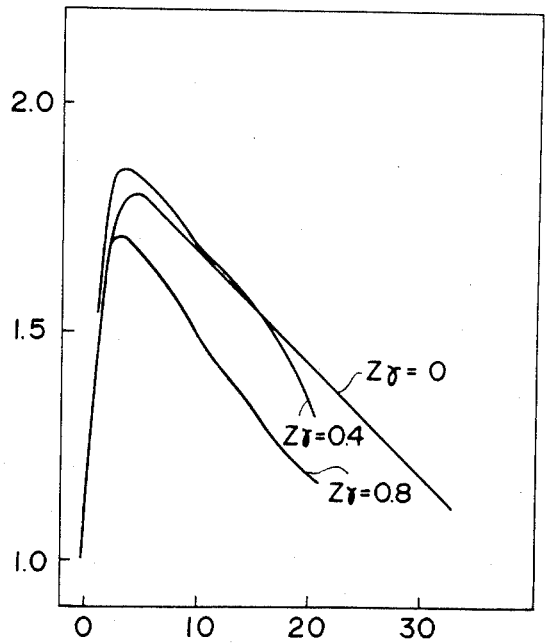

FIG. 14 is a characteristic diagram showing variations in the current breaking capacity of the contact material according to the second embodiment of the present ivnention, when the adding quantity of titanium is varied with respect to the alloy of the contact material, in which the quantity of chromium is fixed at 25% by weight and the quantity of niobium is fixed at 0, 1, 3, 5, 10, 15, and 20% by weight, respectively;

FIG. 15 is a characteristic diagram showing variations in the current breaking capacity of the contact material according to the second embodiment of the present invention, when the quantity of niobium is varied with respect to the alloy of the contact material, in which the quantity of chromium is fixed at 25% by weight and the quantity of titanium is fixed at 0, 0.5, 1.0, and 1.5% by weight, respectively;

FIG. 16 is a characteristic diagram showing variations in the current breaking capacity of the contact material according to the third embodiment of the present invention, when the adding quantity of alumium is varied with respect to the alloy of the contact material, in which the quantity of chromium is fixed at 25% by weight and the quantity of niobium is fixed at 0, 1, 3, 5, 10, 15, and 20% by weight, respectively;

FIG. 17 is a characteristic diagram showing variations in the current breaking capacity of the contact materail according to the third embodiment of the present invention, when the quantity of niobium is varied with respect to the alloy of the contact material, in which the quantity of chromium is fixed at 25% by weight and the quantity of aluminum is fixed at 0, 0.6, and 1.0% by weight, respectively;

FIG. 18 is a characteristic diagram showing variations in the current breaking capacity of the contact material according to the fourth embodiment of the present invention, when the adding quantity of zirconium is varied with respect to the alloy of the contact material, in which the quantity of chromium is fixed at 25% by weight and the quantity of niobium is fixed at 0, 1, 3, 5, 10, 15, and 20% by weight, respectively; and FIG. 19 is a characteristic diagram showing variations in the current breaking capacity of the contact material according to the fourth embodiment of the present invention, when the quantity of niobium is varied with respect to the alloy of the contact material, in which the quantity of chromium is fixed at 25% by weight and the quantity of zirconium is fixed at 0, 0.4, and 0.8% by weight, respectively.

In the following, the present invention will be described in detail in reference to several preferred embodiments thereof shown in the accompanying drawing.

Figure 1:
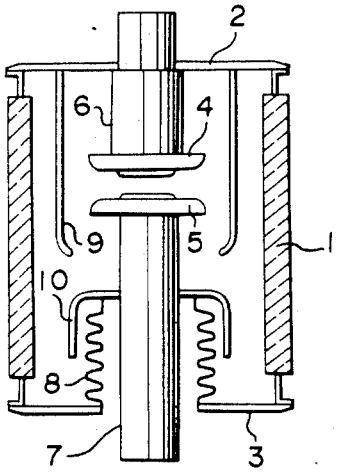
FIG. 1 is a longitudinal cross-sectional view showing a structure of a vacuum switch tube according to a preferred embodiment of the present invention.
Figure 2:
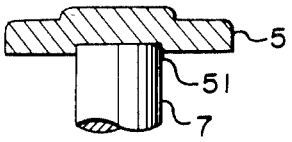
FIG. 2 is an enlarged cross-sectional view of an electrode portion shown in FIG. 1.

Referring first to FIG. 1 showing the first embodiment of the present inventnion, which is a construction of a vacuum switch tube, wherein electrodes 4 and 5 are disposed at one end of respective electrode rods 6 and 7 in a manner to be opposed each other in the interior of a container formed by a vacuum insulative vessel 1 and end plates 2 and 3 for closing both ends of the vacuum insulative vessel 1. The electrode rod 7 is joined with the end plate 3 through a bellow 8 in a manner not to impair the hermetic sealing of the container and to be capable of its axial movement. Shields 9 and 10 cover the inner surface of the vacuum insulative vessel 1 and the bellow 8 so as not to be contaminated with vapor produced by the electric arc. FIG. 2 illustrates the construction of the electrodes 4 and 5. The electrode 5 is soldered on its back surface to the electrode rod 7 with a soldering material 51. The electrodes 4 and 5 are made of a contact material of Cu—Cr—Nb series alloy according to the present ivention.

Figure 3:
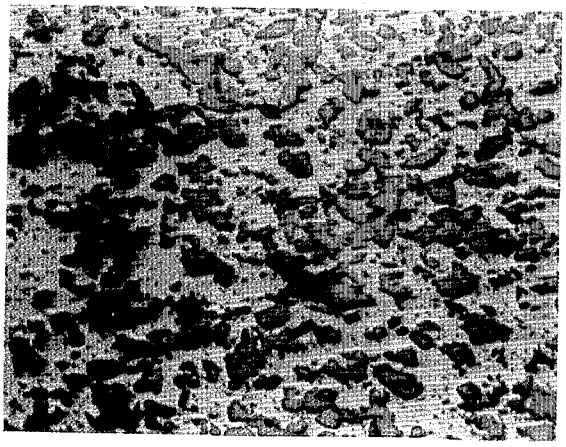
FIG. 3 is a micrograph in the scale of 100 magnification showing a microstructure of a conventional Cu—Cr alloy for the contact material containing 25% by weight of chromium and manufactured by the sintering method.

FIG. 3 is a micrograph in the scale of 100 magnification showing a microstructure of a conventional Cu—Cr alloy contact material, as a comparative example. The Cu—Cr alloy is obtained by mixing 75% by weight of copper powder and 25% by weight of chromium powder, shaping the mixture, and sintering the thus shaped body.

Figure 4:
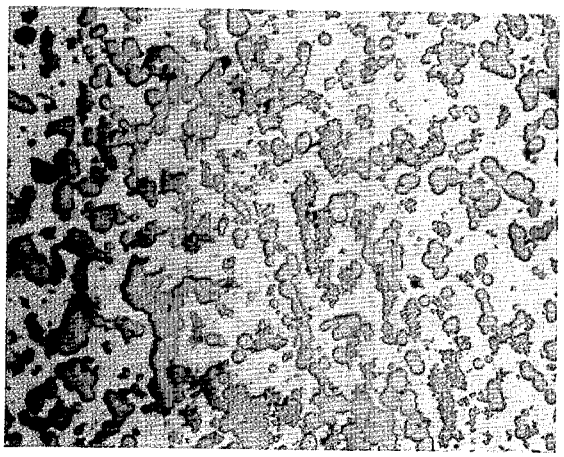
FIG. 4 is also a micrograph in the scale of 100 magnification showing a microstructure of an alloy for the contact material according to the first embodiment of the present invention, in which 5% by weight of niobium is added to a mother alloy consisting of copper and 25% by weight of chromium, and sintered at a high temperature.

FIG. 4 is a micrograph in the scale of 100 magnification showing a microstructure of Cu—Cr—Nb alloy contact material according to the first embodiment of the present invention. The Cu—Cr—Nb alloy is obtained by mixing 75% by weight of copper powder and 25% by weight of chromium powder, to which mixture powder 5% by weight of niobium is added, shaping the mixture, and sintering the thus shaped body. Incidentally, the sintering is done at a temperature of 1,100° C. or so, wherein chromium and a part of niobium react to form $Cr_2Nb$.

Figure 5:
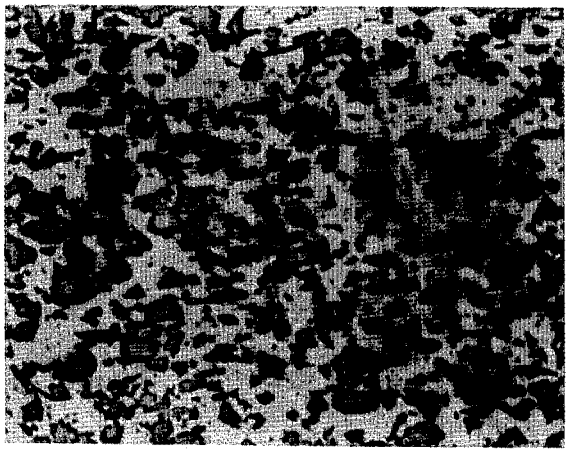
FIG. 5 is a micrograph in the scale of 100 magnification showing a microstructure of an alloy for the contact material according to a modification of the first embodiment of the present invention, having the same composition as the alloy of FIG. 4, but having been sintered at a low temperature.

FIG. 5 is a micrograph in the scale of 100 magnification showing a microstructure of a Cu—Cr—Nb alloy according to a modification of the first embodiment, wherein the alloy is sintered at a relatively low temperature level such that chromium and niobium are difficult to form an alloy or an intermetallic compound. The alloy is obtained by shaping band sintering the mixture of Cu, Cr and Nb metal powder of the same mixing ratio as in the embodiment shown in FIG. 4. It is seen that the alloy of FIG. 4 has Cr, Nb and $Cr_2Nb$ distributed uniformly and minutely in Cu as the basic constituent. Further, the alloy of FIG. 5 has Cr and Nb distributed in Cu mainly as a single metal substance, in which $Cr_2Nb$ can hardly found.

In the following, explanations will be made as to the results of various measurements or experiments done.

First of all, from the experimental results of the present inventors, the binary alloy of Cu and Cr for the contact material has proved to be very excellent in its various capailities, when the contact of Cr therein is in a range of from 20 to 30% by weight. FIGS. 6 to 9 show variations in those characteristics of the alloy for the contact material, wherein the weight ratio between Cu and Cr is maintained at a constant and fixed ratio (75:25) and the amount of Nb to be added thereto is made variable.

Figure 6:
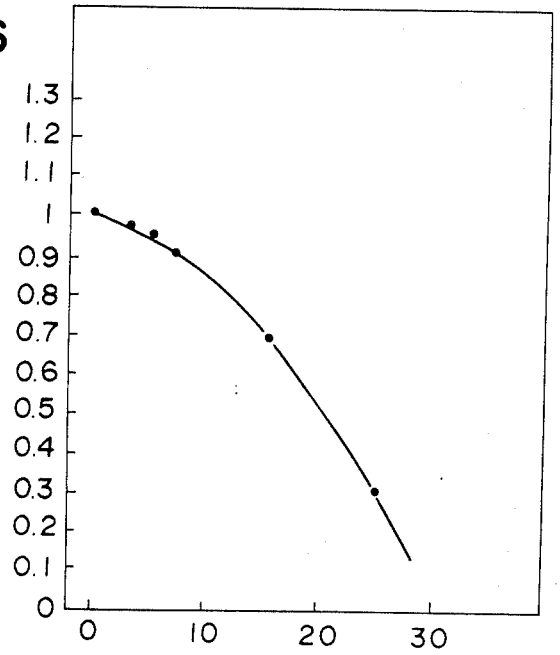
FIG. 6 is a characteristic diagram showing variations in the electrical conductivity of the contact material according to the first embodiment of the present invention, when the added quantity of niobium is varied with respect to the alloy of the contact material, in which the weight ratio of chromium to copper is fixed at 25:75.

FIG. 6 shows a relationship between the electrical conductivity and the amount of Nb added to the alloy, wherein the weight ratio between Cu and Cr is fixed at 75:25. From the graphical representation, it is seen that the electrical conductivity diminishes with increase in the amount of Nb added. In the case of the fixed weight ratio between Cu and Cr in the alloy of 75:25, the added quantity of Nb may be varied depending on the purpose of use of the alloy, although, in particular, the amount should desirably be up to 20% by weight.

Incidentally, the ordinate in the graph of FIG. 6 denotes a ratio when the electrical conductivity of a conventional alloy (Cu—25 wt. % Cr) is made 1, and the abscissa denotes the added quantity of Nb.

Figure 7:
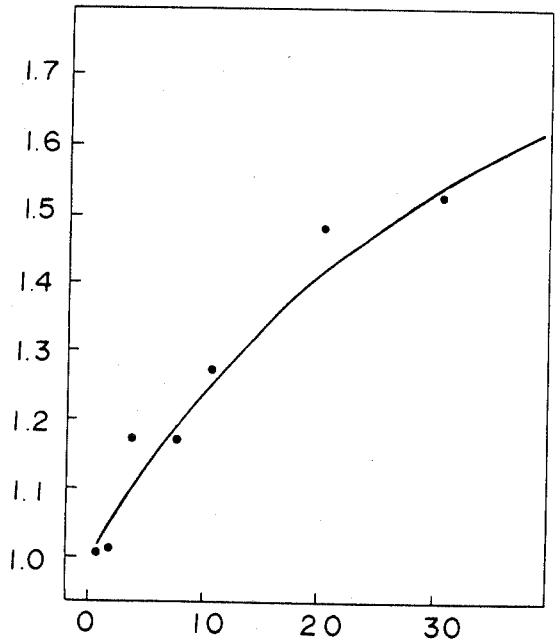
FIG. 7 is also a characteristic diagram showing variations in the contact resistance of the contact material according to the first embodiment of the present invention, when the added quantity of niobium is varied with respect to the alloy of the contact material, in which the weight ratio of chromium to copper is fixed at 25:75.

FIG. 7 shows a relationship between the contact resistance and a quantity of Nb added to the alloy for the contact material, wherein the weight ratio between Cu and Cr is fixed at 75:25. The graph shows a similar tendency to the electrical conductivity. By the way, the ordinate in the graph of FIG. 7 denotes a ratio when the electrical conductivity value of a conventional alloy consisting of Cu and 25% by weight of Cr is made 1.

Figure 8:
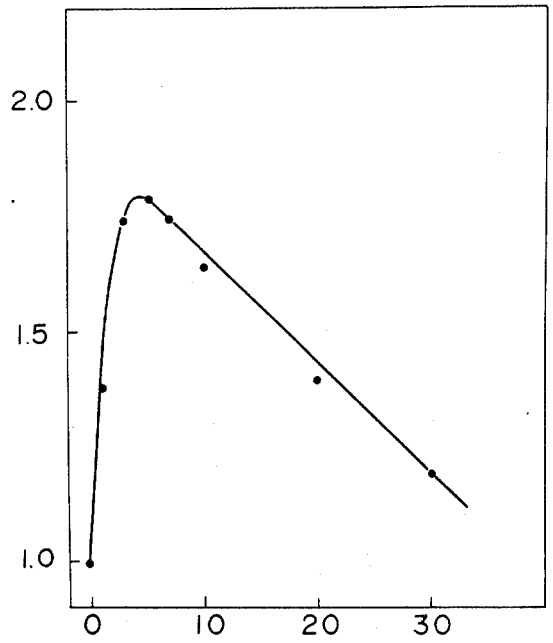
FIG. 8 is a characteristic diagram showing variations in the current breaking capacity of the contact material according to the first embodiment of the present invention, when the added quantity of niobium is varied with respect to the alloy of the contact material, in which the weight ratio of chromium to copper is fixed at 25:75.

FIG. 8 indicatres a relationship between the current breaking capacity and an amount of Nb added to the alloy, in which the weight ratio between Cu and Cr is fixed at 75:25. It is seen from this graphical representation that the alloy added with Nb has a remarkably increased current breaking capability in comparison with the conventional alloy (Cu—25% by weight Cr).

By the way, the ordinate in the graph of FIG. 8 shows a ratio when the electrical conductivity value of the conventional alloy consisting of Cu and 25 wt. % Cr is made 1. As is apparent from FIG. 8, with increase in the adding quantity of Nb, the current breaking capacity of the alloy augments. It reaches 1.8 times as high as that of the conventional alloy with the added quantity of Nb of 5% by weight. When more quantity of Nb than above is added, the current breaking capacity decreases. The reason for this is that, while the current breaking capability can be increased by the mutual action of the coexisting Nb and Cr in the alloy, any further increase in the quantity of Nb and Cr in the alloy causes decrease in the amount of Cu having good electrical conductivity to lower the electrical conductivity and heat conductivity of the alloy, thereby making it difficult to quickly dissipate the heat input due to electric arc and deteriorating the current breaking capability inversely.

Figure 9:
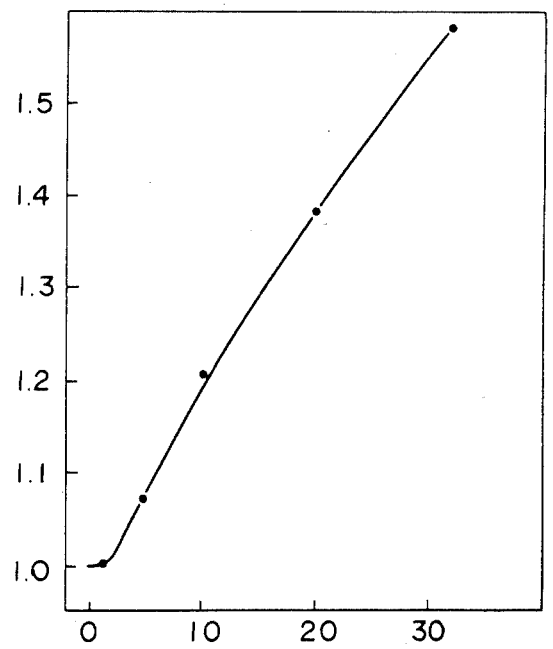
FIG. 9 is a characteristic diagram showing variations in the voltage withstand capability of the contact material according to the first embodiment of the present invention, when the adding quantity of niobium is varied with respect to the alloy of the contact material, in which the weight ratio of chromium to copper is fixed at 25:75.

FIG. 9 shows a relationship between the voltage withstand capability and the added quantity of Nb. As is apparent from the graphical representation, the difference in the voltage withstand capability of the alloy of the invention and the conventional alloy (Cu-25 wt. % Cr) is slight with the added Nb quantity of 3% by weight and below. With increase in its added quantity, however, the voltage withstand capability is seen to rise.

In the following, variations in the characteristics of the alloy are shown, wherein the weight ratio of Cr to Cu is varied in the alloy, in which the quantity of Nb is fixed at 25% by weight.

Figure 10:
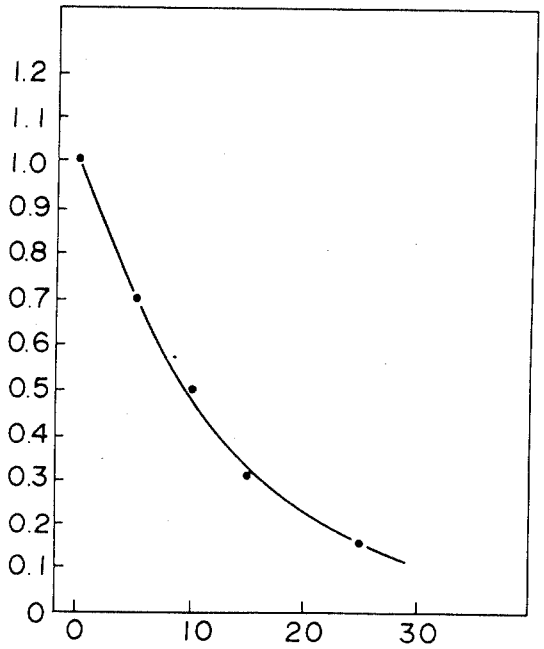
FIG. 10 is a characteristic diagram showing variations in the electrical conductivity of the contact material according to the first embodiment of the present invention, when the weight ratio of chromium to copper in the alloy of the contact material is varied, and the quantity of niobium in the alloy is fixed at 25% by weight.

FIG. 10 indicates a relationship between the electrical conductivity and the weight ratio of Cr to Cu.

Figure 11:
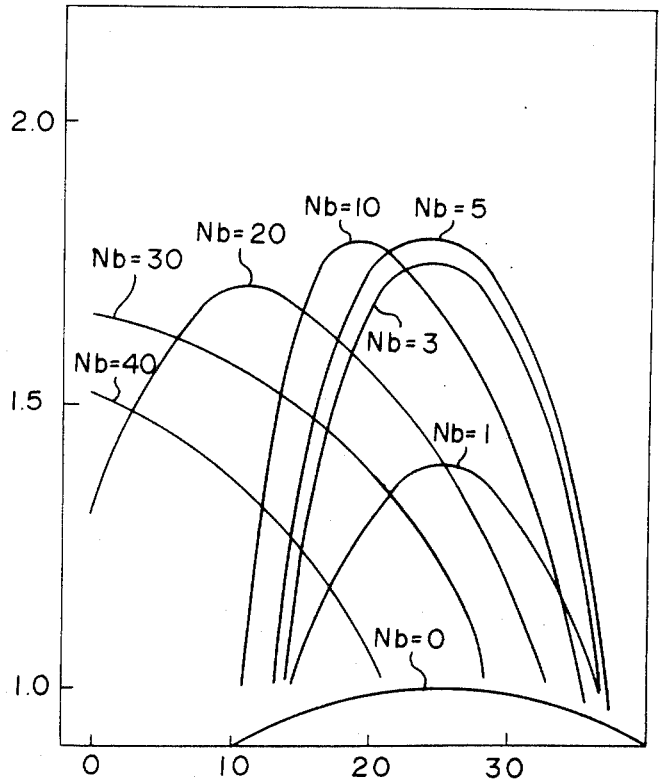
FIG. 11 is a characteristic diagram showing variations in the current breaking capacity of the alloy of the contact material according to the first embodiment of the present invention, when the weight ratio of chromium to copper is varied, and the quantity of niobium is fixed at 0, 1, 3, 5, 10, 20, 30, and 40% by weight, respectively.

FIG. 11 shows a relationship between the current breaking capability and the weight ratio of Cr, when the adding quantity of Nb to the alloy is fixed at 0, 1.3, 5, 10, 20, 30, and 40% by weight, respectively, and the weight ratio of Cr to Cu is varied in each alloy of the above-mentioned Nb content. In the graphical representation, the ordinate represents a ratio when the current breaking capacity value of the conventional alloy (Cu-25 wt. % Cr) is made 1, and the abscissa denotes the weight ratio of Cr to Cu. As seen from the graphical representation, the conventional alloy (Cu—Cr binary alloy) indicates a peak in its current breaking capacity with the Cr content being in a range of from 20 to 30% by weight. A similar tendency is observed when the Nb content is fixed at 1 to 5% by weight. When the Nb content is fixed at 5% by weight, there is observed remarkable increase in the current breaking capability with the weight ratio of Cr to Cu being in a range of from 11% by weight or so to 25% by weight or so. On the other hand, when the Nb content is fixed at 20% by weight, the peak of the current breaking capacity appears at the weight ratio of Cr to Cu being in a range of from 5 to 15% by weight, the peak value of which is somewhat inferior to the alloy of the Nb content of 5% by weight.

Figure 12:
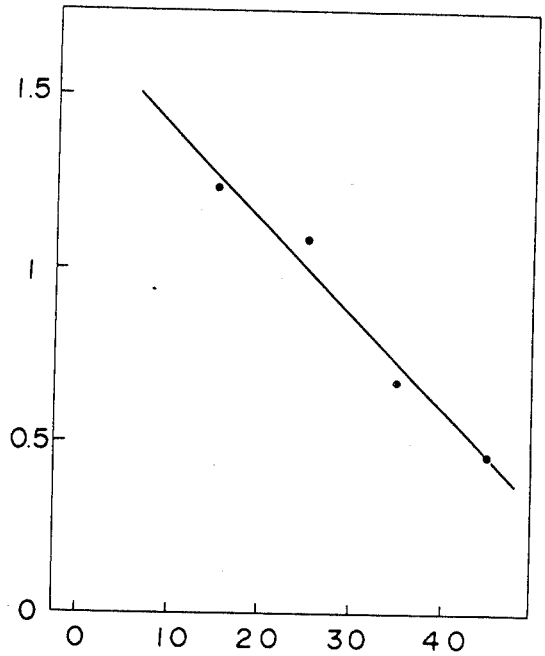
FIG. 12 is a characteristic diagram showing, for the purpose of reference, relationship between the quantity of niobium and the electrical conductivity in a Cu—Nb binary alloy.
Figure 13:
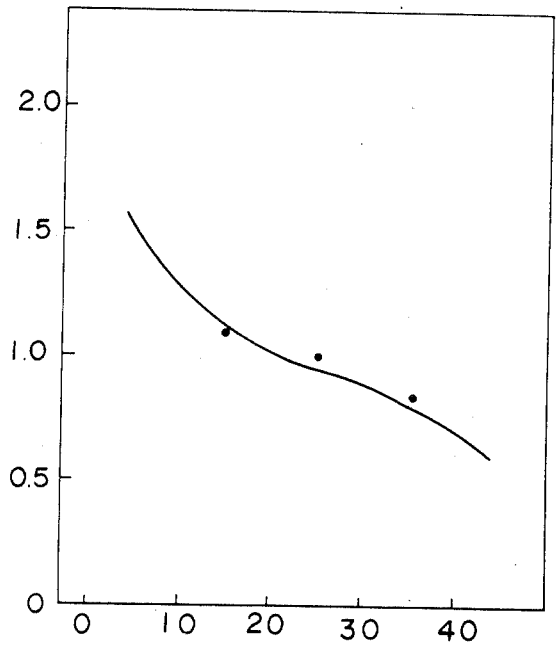
FIG. 13 is a characteristic diagram showing, for the purpose of reference, a relationship between the quantity of chromium and the electrical conductivity in a Cu—Cr binary alloy.

FIG. 12 shows a relationship between the electrical conductivity and the Nb content in the binary alloy of Cu and Nb, and FIG. 13 indicates a relationship betweeen the electrical conductivity and the Cr content in the binary alloy of Cu and Cr. It will be seen from both graphical representations that, as each of Nb and Cr increases, the electrical conductivity diminishes and the electrical conductivity required generally of the contact for the current breaking raches the limit with the Nb content of 40% by weight or so and with the Cr content of 40% by weight or so, beyond which content of Nb and Cr, there emerge practical mal-effects from the standpoints of electrical conduction, current breaking, and so on. As is apparent from FIG. 11 in the co-presence of Nb and Cr, there is observed improvement in the curent breaking capability with the Cr content of 35% by weight or below with respect to the whole contact material, and no effect can be obtained when the Cr content is increased further. On the other hand, from the aspect of Nb, the improvement is seen in the current breaking capability by addition of even a small quantity of Nb, owing to its coexistence with Cr. A practical Nb content may be 40% by weight or below. Incidentally, it seems that, even in the Nb content of 40% by weight or above, there is an effective range from the standpoint of the current breaking capability. The alloy of this figure of the Nb content, however, is difficult to be realized for the practical purpose, except for the circuit breaker of a particular use, because such alloy is difficult to be obtained by an ordinary sintering method and, as is apparent from FIG. 12, with the Nb content of 40% by weight and above, the electrical conductivity becomes low and the contact resistance becomes high.

Furthermore, from FIG. 11, a range of the weight ratio of the constituent elements in the alloy, wherein the current breaking capability remarkably increases (exceeding 1.5 times) in comparison with the conventional alloy, should desirably be 1 to 30% by weight of Nb and up to 33% by weight of Cr to Cu.

By the way, the abovementioned experimental examples indicate various characteristics of the alloys, in which Cr, Nb and $Cr_2Nb$ are uniformly and finely distributed in Cu ($Cr_2Nb$ being an intermetallic compound consisting of Cr and Nb). It should, however, be noted that, even the alloy obtained from a lower sintering temperature and in which Cu, Cr and Nb are distributed almost in the form of single substance exhibits substantially same tendency as mentioned above, and has a remarkably large current breaking capability in comparison with the conventional alloy (consisting of Cu-25 wt. % Cr). On the other hand, however, it has also been found that the Cu—Cr—Nb alloy obtained by mixing the same constituent elements at the same ratio as mentioned above, shaping the mixture, and sintering the shaped material is excellent in its current breaking capability, if the intermetallic compound of Cr and Nb has been formed in it.

Moreover, though not shown in the drawing, it has also been verified that even a contact for a low chopping, vacuum circuit breaker obtained from the abovementioned alloy which is added at least one kind of low melting point metals such as Bi, Te, Sb, Tl, Pb, Se, Ce and Ca, alloys of these metals, and intermetallic compounds of these metals has the effect of increasing the current breaking capability and the voltage withstand capability same as the abovementioned experimental examples.

When at least one of those low melting point metals, their alloys and their intermetallic compounds is added to the alloy for the contact material at a rate of 20% by weight or above, the current breaking capability remarkably lowered.

As explained in the foregoing, the contact material according to this first embodiment of the present invention is characterized by containing copper as the basic component and, Cr and Nb as the other components, wherein copper, chromium and niobium are distributed therein in the form of a single metal or as at least one kind of a ternary alloy of these metals, a binary alloy of these metals, a ternary intermetallic compound of these metals, a binary intermetallic compound of these metals, and a composite body of these thereby obtaining excellent current breaking capability and high voltage withstand capability.

In the following, the second embodiment of the present invention will be explained. In this second embodiment, a Cu—Cr—Nb—Ti series alloy is used as the contact material for the electrodes 4 and 5 shown in FIG. 1.

FIG. 14 indicates a relationship between the current breaking capacity and the Ti content added to the alloy for the contact material, wherein the Cr content is fixed at 25% by weight, and the Nb content is fixed at 0, 1, 3, 5, 10, 15, and 20% by weight, respectively. In the graphical representation in FIG. 14, the ordinate represents a ratio when the current breaking capacity of the conventional alloy (consisting of Cu-25 Cr) is made 1, and the abscissa denotes the added quantity of Ti. In FIG. 14, a reference letter A indicates the current breaking capacity of the conventional alloy (consisting of Cu-25 Cr). As seen from the graphical representation, with increase of the added quantity of Ti, the current breaking capacity rises and when the added quantity of Ti is 0.5% by weight for the respective Nb contents, there appears a peak in the current breaking capacity. However, when the Nb content is 15% by weight, if the Ti content is 0.5% by weight or below, there is no change in the current breaking capability, and, if the Ti content exceeds 0.5% by weight, rather, decrease in current breaking capability takes place. Further, when the Nb content reaches 20% by weight, the current breaking capacity decreases with increase of Ti content. Namely, the effect for improving the current breaking capacity to be derived from addition of Ti is effective when the Nb content is 15% by weight or below. More concretely, when 0.5% by weight of Ti is added with respect to 3% by weight of Nb, the alloy exhibits its current breaking capacity of 1.9 times as large as that of the conventional alloy (consisting of Cu-25 wt. % Cr). However, in this case, if the Ti content increases unnecessarily, rather decrease in current breaking capability takes place. In other words, when the Nb content is relatively small, alloy and compound to be produced by appropriate reaction between Ti and other elements disperse uniformly and minutely to remarkably increase the current breaking capability, and yet the Cu content is sufficient to maintain the electrical conductivity and heat conductivity without lowering them, so that the heat input due to electric arc can be quickly dissipated. However, when the Nb content increases, the Cu content decreases inevitably, so that, even if alloy and compound itself to be produced by the reaction between Cu and Ti has a function of increasing the current breaking capability, its adverse effect of lowering the electrical conductivity and heat conductivity becomes overwhelming, whereby the factors for improving the current breaking capability to be brought about by the reaction between Ti and other elements are overcome and, as a whole, the current breaking capability does not appear improve and rather, is lowered. Also, with the same Nb content, when the Ti content exceeds an appropriate quantity to exhibit its effect, the electrical conductivity and the heat conductivity of Cu also lower remarkably, which is not favorable. In passing, it should be noted that the Cu—Cr—Nb—Ti alloy used in this experiment was obtained by shaping and sintering a mixture powder of Cu, Cr, Nb and Ti at a required quantity for each of them.

FIG. 15 indicates a relationship between the current breaking capacity and the Nb content added to the alloy for the contact material, wherein the Cr content is fixed at 25% by weight, and the Ti content is fixed at 0, 0.5, 1.0, and 1.5% by weight, respectively. In the drawing, the ordinate denotes a ratio when the current breaking capacity of the conventional alloy (consisting of Cu-25 wt. % Cr) is made 1, and the abscissa denotes the added quantity of Nb. As seen from FIGS. 14 and 15, it is with 15% by weight or below of Nb added that the increased effect in the current breaking capacity can be observed by the addition of Ti at a rate of 0.5% by weight. On the other hand, when Ti content is 1% by weight, the increased effect in the current breaking capability can be observed only in case the Nb content is very small (1% by weight or so). Therefore, the added quantity of Ti is preferably 1% by weight or below. In contrast to these, with the Ti content being in a range of 0.5% by weight or below, there emerges an improved effect in the current breaking capability over the broadest range of the Nb content, i.e., a range of 15% by weight or below.

From the abovementioned results, ranges of 0.8% by weight or below of Ti and 2 to 7% by weight of Nb are preferably for further improvement in the current breaking capability of the ternary alloy of Cu—Cr—Nb by addition of Ti thereto.

The present inventors conducted experiments as shown in FIGS. 14 and 15 by varying the Cr content. With the Cr content in a range of from 10 to 35% by weight, there could be observed improvement in the current breaking capability due to addition of Ti, while, with the Cr content in a range of 10% by weight or less, there took place no change in the current breaking capability even by addition of Ti. Conversely, when the Cr content exceeds 35% by weight, there takes place lowering of the current breaking capability.

On the other hand, the contact material made of the Cu—Cr—Nb—Ti series alloy containing Cr in a range of from 10 to 35% by weight, Nb in a range of 15% by weight or less, and Ti in a range of 1% by weight or less is not inferior in its contact resistance to the conventional alloy (consisting of Cu-25 wt. % Cr) and is also satisfactory in its voltage withstand capability, which, though not shown in the drawing, have been verified from various experiments.

It has also been verified, though not shown in the drawing, that the current breaking property can be effectively increased and a good voltage withstand capability can be observed in the same manner as in the above-described embodiments even in the contact material for a low chopping, vacuum circuit breaker made of an alloy added with 20% by weight or less of at least one kind of the low melting point metals such as Bi, Te, Sb, Tl, Pb, Se, Ce and Ca, and at least one kind of their alloys, their intermetallic compounds, and their oxides.

Incidentally, when at least one kind of the low melting point metals, their alloys, their intermetallic compounds, and their oxides is added to the alloy in an amount of 20% by weight and above, the current breaking capability and the voltage withstand capability of the alloy decreased remarkably. Moreover, in the case of the low melting point metal being Ce or Ca, the charactersitics of the alloy are somewhat inferior.

In this second embodiment of the present invention, explanations have been made in terms of the Cu—Cr—Nb—Ti alloy. It should, however, be noted that the expected object can be achieved, even when each element in the alloy is distributed therein as a single substance, a binary, ternary or quaternary alloy, a binary, ternary or quaternary intermetallic compound, or a composite body of these.

As mentioned in the foregoing, the second embodiment of the present invention is characterized in that the alloy for the contact material consists essentially of copper, 10 to 35% by weight of chromium, 15% by weight or below of niobium, and 1% by weight or below of titanium. Therefore, the invention has its effect such that the contact material for the vacuum circuit breaker excellent in its current breaking capability and having satisfactory voltage withstand capability can be obtained even if the Nb content is reduced.

The third embodiment of the present invention will now be explained hereinbelow in reference to FIGS. 16 and 17. In this embodiment, a Cu—Cr—Nb—Al series alloy material is used as the contact material for the electrodes 4 and 5 shown in FIG. 1.

FIG. 16 indicates a relationship between the current breaking capacity and the Al content added to the alloy, in which the Cr content is fixed at 25% by weight and the Nb content is fixed at 0, 1, 5, 10, 15, and 20% by weight, respectively.

In the graphical representation of FIG. 16, the ordinate denotes a ratio when the current breaking capacity of conventional alloy (Cu-25 wt. % Cr) is made 1, and the abscissa denotes the adding quantity of Al. In FIG. 16, a reference letter A represents the current breaking capacity of the conventional alloy (Cu-25 wt. % Cr). As seen from the graphical representation, with increase of the added quantity of Al, the current breaking capacity rises and when the adding quantity of Al is 0.6% by weight for the respective content of Nb, there appears a peak in the current breaking capacity. However, when the quantity of Nb is 20% by weight, if the Al content is 0.5% by weight or below, there is no change in the current breaking capability, and, if the Al content exceeds 0.6% by weight rather, there takes place decrease in the current breaking capability. Also, when the Nb content exceeds 20% by weight, the current breaking capacity diminishes as the quantity of Al increases. Namely, the effect for improving the current breaking capability to be derived from addition of Al is effective when the Nb content is 20% by weight or below. When 0.6% by weight of Al is added with respect to 3% by weight of Nb, the current breaking capacity becomes 1.8 times as high as that of the conventional alloy (Cu-25 wt. % Cr). However, in this case, if the Al content increases unnecessarily, rather decrease in current breaking capability takes place. That is to say, when the quantity of Nb is relatively small, alloy and compound to be produced by appropriate reaction of Al with other elements are uniformly and minutely dispersed in the alloy to remarkably increase the current breaking capability thereof, and yet the quantity of Cu is so sufficient as to maintaining the electrical conductivity and the heat conductivity of the alloy, hence the heat input due to electrical arc can be quickly dissipated. When the quantity of Nb becomes increased, however, the quantitative ratio of Cu becomes inevitably lowered, so that, even if alloy and compound itself to be produced by the reaction between Cu and Al has a function of increasing the current breaking capability, its adverse effect of lowering the electrical conductivity and the heat conductivity becomes overwhelming, with the consequence that the factors for improving the current breaking capability to be brought about by the reaction between Al and other elements are overcome and, as a whole, the current breaking capability does not appear to improve and rather is lowered. Also, with the same quantity of Nb when the quantity of Al exceeds an appropriate quantity to exhibit its effect, the electrical conductivity and the heat conductivity of Cu also decreases remarkably, which is not favorable. In passing, it should be noted that the Cu—Cr—Nb—Al alloy used in this experiment was obtained by shaping and sintering a mixture powder of Cu, Cr, Nb and Al at a required quantity for each of them.

FIG. 17 indicates a relationship between the current breaking capacity and the quantity of Nb, when the Cr content in the alloy for the contact material is fixed at 25% by weight and the Al content is fixed at 0, 0.6, and 1.0% by weight, respectively. In the drawings, the ordinate denotes a ratio when the current breaking capacity of the conventional alloy (consisting of Cu-25 wt. % Cr) is made 1, the the abscissa denotes the added quantity of Nb. As seen from FIGS. 16 and 17, it is with 20% by weight or below of the quantity of Nb added that the increased effect in the current breaking capacity can be observed over the broadest range by addition of Nb when the quantity of Al is 0.6% by weight. On the other hand, when Al content is 1% by weight, the increased effect in the current breaking capability, can be observed only in case the Nb content is 1% by weight or so. Therefore, the adding quantity of Al is preferably 1% by weight or below. In contrast to these, with the Al content being in a range of 0.6% by weight or below, there emerges an improved effect in the current breaking capability over the broadest range of the Nb content, i.e., a range of 20% by weight or below.

From the abovementioned results, ranges of 0.7% by weight or below of Al and 2 to 7% by weight of Nb are preferably for further improvement in the current breaking capability of the ternary alloy of Cu—Cr—Nb by addition of Al thereto.

The present inventors conducted experiments as shown in FIGS. 16 and 17 by varying the quantity of Cr. With the quantity of Cr being in a range of from 10 to 35% by weight, there could be observed improvement in the current breaking capability due to addition of Al. With the quantity of Cr being in a range of 10% by weight or below, there took place no change in the current breaking capability even by addition of Al. Conversely, when the quantity of Cr exceeds 35% by weight, there takes palce lowering of the current breaking capability.

On the other hand, the contact material made of the Cu—Cr—Nb—Al series alloy containing Cr in a range of from 10 to 35% by weight, Nb in a range of 20% by weight or below, and Al in a range of 1% by weight or below is not inferior in its contact resistance to the conventional alloy (consisting of Cu-25 wt. % Cr) and has as good a voltage withstand capability as that of the conventional alloy, which have been verified from various experiments, though not shown in the drawing.

It has also been verified, though not shown in the drawing, that the current breaking property can be effectively increased and a good voltage withstand capability can be observed in the same manner as in the above-described embodiments even in the contact material for a low chopping, vacuum circuit breaker made of an alloy added with 20% by weight or below of at least one kind of the low melting point metals such as Bi, Te, Sb, Tl, Pb, Se, Ce and Ca, and at least one kind of their alloys, their intermetallic compounds, and their oxides.

Incidentally, when at least one kind of the low melting point metals, their alloys, their intermetallic compounds, and their oxides is added to the alloy in an amount of 20% by weight and above, the current breaking capability and the voltage withstand capability of the alloy decreased remarkably. Moreover, in the case of the low melting point metal being Ce or Ca, the characteristics of the alloy are somewhat inferior.

In this third embodiment of the present invention, explanations have been made in terms of the Cu—Cr—Nb—Al alloy. However, it is apparent that the expected object can be achieved, even when each element in the alloy is distributed therein as a single substance, a binary, ternary or quaternary alloy, a binary, ternary or quaternary intermetallic compound, or a composite body of these.

As mentioned in the foregoing, the third embodiment of the present invention is characterized in that the alloy for the contact material consists essentially of copper, 10 to 35% by weight of chromium, 20% by weight or below of niobium, and 1% by weight or below of aluminum. Therefore, the present invention has its effect such that the contact material for the vacuum circuit breaker excellent in its current breaking capability and having satisfactory voltage withstand capability can be obtained even if the quantity of Nb is reduced.

The fourth embodiment of the present inventnion will now be explained hereinbelow in refernce to FIG. 18 and 19. In this embodiment, a Cu—Cr—Nb—Zr series alloy material is used as the contact material for the electrodes 4 and 5 shown in FIG. 1.

FIG. 18 indicates a relationship between the current breaking capacity and the Zr content added to the alloy, in which the Cr content is fixed at 25% by weight and the quantity of Nb is fixed at 0, 1, 3, 5, 10, 15, and 20% by weight, respectively. In the graphical representation of FIG. 18, the ordinate represents a ratio when the current breaking capacity of a conventional alloy (Cu-25 wt. % Cr) is made 1, and the abscissa denotes the added quantity of Zr. In FIG. 18, a reference letter A indicates the current breaking capacity of the conventional alloy (Cu-25 wt. % Cr). As seen from the graphical representation, when the added quantity of Zr is 0.4 by weight for the respective quantities of Nb, there appears a peak in the current breaking capacity, from which further improvement is seen in the current breaking capability by addition of Zr. However, when the quantity of Nb becomes 15% by weight, if the Zr content is 0.4% by weight or below, there is no change in the current breaking capability, and, if the Zr content exceeds 0.4% by weight, rather, there takes place decrease in the current breaking capacity. Also, when the Nb content reaches 20% by weight, the current breaking capacity decreases with increase of Zr content. Namely, the effect for improving the current breaking capability to be derived from addition of Zr is effective when the Nb content is 15% by weight or below. When 0.4% by weight of Zr is added with respect to 3% by weight of Nb, the current breaking capacity becomes 1.85 times as high as that of the conventional alloy (Cu-25 wt. % Cr). However, in this case, if the Zr content increases unnecessarily, rather decrease in current breaking capability takes place. That is to say, when the quantity of Nb is relatively small, those alloy and compound to be produced by appropriate reaction of Zr with other elemets are uniformly and minutely dispersed in the alloy to remarkably increase the current breaking capability thereof, and yet the quantity of Cu is so sufficient as to maintaining the electrical conductivity and the heat conductivity of the alloy, hence the heat input due to electrical arc can be quickly dissipated. However, when the quantity of Nb becomes increased, the quantitative ratio of Cu becomes inevitably lowered, so that, even if alloy and compound itself to be produced by the reaction between Cu and Zr has a function of increasing the current breaking capability, its adverse effect of lowering the electrical conductivity and the heat conductivity becomes overwhelming, with the consequence that the factors for improving the current breaking capability to be brought about by the reaction between Zr and other elements are overcome, and, as a whole, the current breaking capability does not appear to improve and rather, is lowered. Also, with the same quantity of Nb, when the quantity of Zr exceeds an appropriate quantity to exhibit its effect, the electrical conductivity and the heat conductivity also lower remarkably, which is not favorable. In passing, it should be noted that the Cu—Cr—Nb—Zr alloy used in this experiment was obtained by shaping and sintering a mixture powder of Cu, Cr, Nb and Zr at a required quantity for each of them.

FIG. 19 shows a relationship between the current breaking capacity and the quantity of Nb, when the Cr content in the alloy for the contact material is fixed at 25% by weight and the Zr content is fixed at 0, 0.4, and 0.8% by weight, respectively. In the drawing, the ordinate represents a ratio when the current breaking capacity of the conventional alloy (consisting of Cu-25 wt. % Cr) is made 1, and the abscissa represents the added quantity of Nb. As seen from FIGS. 18 and 19, it is with 15% by weight or below of the quantity of Nb added that the increased effect in the current breaking capacity can be observed most eminently by addition of Zr, when the quantity of Zr is 0.4% by weight. On the other hand, when the Zr content is 0.8% by weight, the effect for improving the current breaking capability can be observed only when the quantity of Nb is 1% by weight or so. Therefore, the added quantity of Zr is preferably 0.8% by weight or below. In contrast to these, with the Zr content being in a range of 0.4% by weight or below, there emerges an improved effect in the current breaking capability over the broadest range of the Nb content, i.e., a range of 15% by weight or below.

From the abovementioned results, it is desirable that the quantity of Zr be in a range of 0.65% by weight or below and the quantity of Nb be in a range of from 2 to 7% by weight for further improvement in the current breaking capability of the ternary alloy of Cu—Cr—Nb by addition of Zr thereto.

The present inventors conducted experiments as shown in FIGS. 18 and 19 by varying the quantity of Cr. With the quantity of Cr being in a range of 10 to 35% by weight, there could be observed improvement in the current breaking capability by the addition of Zr. However, with the quantity of Cr being in a range of 10% by weight or below, there could be seen no change in the current breaking capability even by addition of Zr. Conversely, when the quantity of Cr exceeds 35% by weight, there takes place lowering of the current breaking capability.

On the other hand, the contact material made of the Cu—Cr—Nb—Zr series alloy containing Cr in a range of from 10 to 35% by weight, Nb in a range of 15% by weight or below, and Zr in a range of 0.8% by weight or below is not inferior in its contact resistance to the conventional alloy (consisting of Cu-25 wt. % Cr) and has as good a voltage withstand capability as that of the conventional alloy, which have been verified from various experiments, though not shown in the drawing.

It has also been verified, though not shown in the drawing, that the current breaking property can be effectively increased and a good voltage withstand capability can be observed in the same manner as in the above-described embodiments even in the contact material for a low chopping, vacuum circuit breaker made of an alloy added with 20% by weight or below of at least one kind of the low melting point metals such as Bi, Te, Sb, Tl, Pb, Se, Ce and Ca, and at least one kind of their alloys, their intermetallic compounds and their oxides.

Incidentally, when at least one kind of the low melting point metals, their alloys, their intermetallic compounds, and their oxides is added to the alloy in an amount of 20% by weight and above, the current breaking capability of the alloy decreased remarkably. Moreover, in the case of the low melting point metal being Ce or Ca, the characteristics of the alloy are somewhat inferior.

In this fourth embodiment of the present invention, explanations have been made in terms of the Cu—Cr—Nb—Zr alloy. It is apparent, however, that the expected objective can be achieved, even when each element of the alloy is distributed there in as a single substance, a binary, ternary or quaternary alloy, a binary, ternary or quaternary intermetallic compound, or a composite body of these.

As mentioned in the foregoing, the fourth embodiment of the presetn invention is characterized in that the alloy for the contact material consists essentially of copper, 10 to 35% by weight of chromium, 15% by weight or below of niobium, and 0.8% by weight or below of zirconium. Therefore, the present invention has its effect such that the contact material for the vacuum circuit breaker excellent in its current breaking capability and having satisfactory voltage withstand capability can be obtained, even if the quantity of Nb is reduced.

We claim:

1. A contact material for a vacuum circuit breaker, which consists essentially of:

copper as the basic component, and, as the other component, from 5 to 35% by weight of chromium and from 1% to 40% by weight of niobium, the total quantity of chromium and niobium in said contact material being at least 10% by weight.

2. The contact material for a vacuum circuit breaker according to claim 1, wherein the niobium content is in a range of from 1 to 30% by weight.

3. The contact material for a vacuum circuit breaker according to claim 1, wherein copper, chromium and niobium are distributed therein as a single metal, as a ternary alloy of these metals, as a binary alloy of these metals, as a ternary intermetallic compound of these metals, as a binary intermetallic compound of these metals, or as combinations thereof.

4. The contact material for a vacuum circuit breaker according to claim 1, further containing no more than 20% by weight of at least one low melting point metal selected from the group consisting of bismuth, tellurium, antimony, thallium, lead, selenium, cerium, and calcium, at least one alloy of said low melting point metals or an intermetallic compound of said low melting point metals.

5. A contact material for a vacuum circuit breaker which consists essentially of copper as the basic component, and, as the other components, 10 to 35% by weight of chromium, from 1% to 15% by weight of niobium, and no more than 1% by weight of titanium.

6. The contact material for a vacuum circuit breaker according to claim 5, wherein the quantity of titanium is no more than 0.8% by weight.

7. The contact material for a vacuum circuit breaker according to claim 5, wherein niobium is in the range of from 2 to 7% by weight.

8. The contact material for a vacuum circuit breaker according to claim 5, further containing no more than 20% by weight of at least one low melting point metal selected from the group consisting of bismuth, tellurium, antimony, thallium, lead, selenium, cerium, and calcium, at least one alloy of said low melting point metals, an intermetallic compound of said low melting point metals, or at least one oxide of said low melting point metals.

9. A contact material for a vacuum circuit breaker which consists essentially of copper as the basic component, and, as the other components, 10 to 35% by weight of chromium, from 1% to 15% by weight of niobium, and no more than 0.8% by weight of zirconium.

10. The contact material for a vacuum circuit breaker according to claim 9, wherein the quantity of zirconium is no more than 0.65% by weight.

11. The contact material for a vacuum circuit breaker according to claim 9, wherein niobium is in the range of from no more than 2 to 7% by weight.

12. The contact material for a vacuum circuit breaker according to claim 9, further containing no more than 20% by weight of at least one low melting point metal selected from the group consisting of bismuth, tellurium, antimony, thallium, lead, selenium, cerium, and calcium, at least one alloy of said low melting point metals, an intermetallic compound of said low melting point metals, or at least one oxide of said low melting point metals.

13. A contact material for a vacuum circuit breaker which consists essentially of copper as the basic component, and, as the other components, 10 to 35% by weight of chromium, from 1% to 20% by weight of niobium, and no more than 1% by weight of aluminum.

14. The contact material for a vacuum circuit breaker according to claim 13, wherein the quantity of aluminum is no more than 0.6% by weight.

15. The contact material for a vacuum circuit breaker according to claim 13, wherein niobium is in the range of from 2 to 7% by weight.

16. The contact material for a vacuum circuit breaker according to claim 13, further containing no more than 20% by weight of at least one low melting point metal selected from the group consisting of bismuth, tellurium, antimony, thallium, lead, selenium, cerium, and calcium, at least one alloy of said low melting point metals, an intermetallic compound of said low melting point metals or at least one oxide of said low melting point metals.

* * * * *